United States Patent [19]

Dow

[11] 4,130,261

[45] Dec. 19, 1978

[54] BAG FILLING DEVICE

[76] Inventor: Ray A. Dow, 804 N. Ross, Dewey, Okla. 74029

[21] Appl. No.: 786,063

[22] Filed: Apr. 11, 1977

[51] Int. Cl.[2] ..... A63B 55/04

[52] U.S. Cl. ..... 248/97; 141/316; 248/101

[58] Field of Search ..... 248/97, 99, 101; 232/43.2, 43.1; 141/316, 390

[56] References Cited

U.S. PATENT DOCUMENTS

| | | | |
|---|---|---|---|
| 42,283 | 4/1864 | Godfrey | 248/97 X |
| 704,833 | 7/1902 | Johnson | 248/97 |
| 754,580 | 3/1904 | Madden et al. | 248/97 |
| 1,052,379 | 2/1913 | Ranken et al. | 248/97 X |
| 2,817,476 | 12/1957 | Mills | 232/43.1 |
| 3,091,422 | 5/1963 | Hobbs | 248/101 |
| 3,627,243 | 12/1971 | Farrelli | 248/99 |
| 3,684,225 | 8/1972 | Crawford et al. | 248/99 |
| 3,818,956 | 6/1974 | Chamberlain | 141/316 |
| 3,915,329 | 10/1975 | Zaks | 141/316 X |
| 4,014,157 | 3/1977 | Pearce | 141/390 X |

FOREIGN PATENT DOCUMENTS

| | | | |
|---|---|---|---|
| 2555711 | 6/1976 | Fed. Rep. of Germany | 248/99 |
| 1246533 | 10/1960 | France | 248/101 |

*Primary Examiner*—Rodney H. Bonck
*Attorney, Agent, or Firm*—John H. Widdowson

[57] ABSTRACT

A bag filling device for receiving a plastic bag or the like therein and holding the bag in an open position for filling the bag with various types of articles such as lawn cuttings, leaves, trash etc. . . The bag filling device provides a convenient way of holding various sizes of plastic bags in an open position until the bag is completely filled. When the plastic bag is filled, the bag can be quickly removed from the device so that the top of the bag may be closed and tied.

2 Claims, 4 Drawing Figures

BAG FILLING DEVICE

BACKGROUND OF THE INVENTION

This invention relates generally to a bag filling device and more particularly, but not by way of limitation, to a device used for holding open plastic bags for collecting lawn cuttings, leaves, trash, or the device may be used with smaller plastic bags used in the storing and freezing of food products.

Heretofore, there have been various types of bag holders, bagging devices, refuse holders and bag emptying devices. These devices include various types of structure used in holding open paper sacks, trash bags, or the like. None of these prior art bag devices disclose the novel structure as described herein for holding open various sizes of plastic bags.

SUMMARY OF THE INVENTION

The subject bag filling device may be used for receiving various types and sizes of plastic bags used for a variety of jobs such as lawn and garden care, garbage and trash removal, or any other activity requiring the use of a plastic bag.

The device can be quickly and securely attached to the top of a bag wherein the device retains the bag in an open position so that the bag may be completely filled. When the bag is filled, it is quickly removed from the device so that the top of the bag may be closed and tied.

The invention is rugged in construction, lightweight, and can be easily adapted to various sizes and shapes of plastic, paper, or cloth bags.

The bag filling device includes a cylindrical shaped tube, having an open top portion and an open bottom portion. The sides of the tube are tapered upwardly and inwardly from the bottom portion to the top portion. The plastic bag or the like is inserted through the open bottom portion of the tube with the top of the bag extending outwardly through the open top portion with the edges of the top of the bag folded over the top portion of the tube. A pair of semicircular handles are pivotally mounted on the top portion of the tube. When the handles are pivoted adjacent the sides of the top portion of the tube, they engage the top edge of the bag and compress the bag against the sides of the tube, thereby holding the bag therebetween. The bag filling device further includes hand holes through the sides of the tube for lifting the device when in use. The device also includes a hook for storing the device when not in use.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
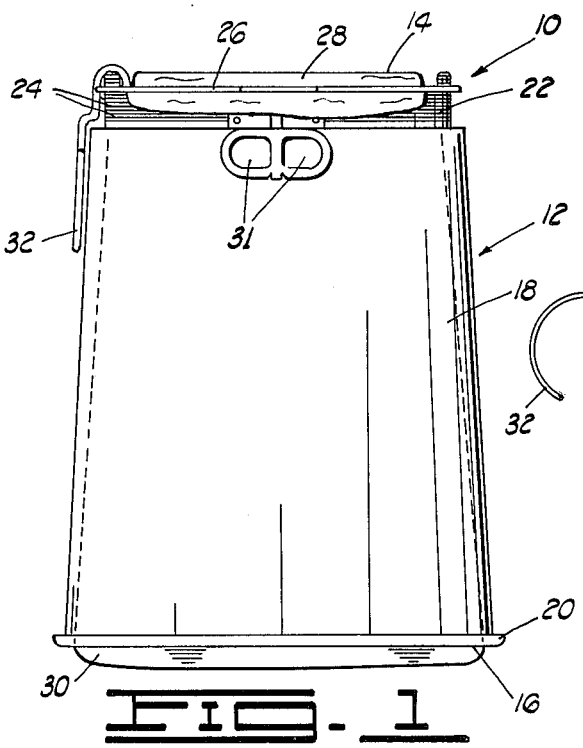
FIG. 1 is a front view of the bag filling device with a plastic bag retained therein.

In FIG. 1, the bag filling device is designated by general reference numeral 10. The device 10 includes a cylindrical shaped tube 12. The tube 12 includes an open top portion 14, an open bottom portion 16, and tapered side portions 18. The side portions 18 are tapered upwardly and inwardly from the open bottom portion 16, toward the open top portion 14. The open bottom portion 16 includes a curved flange portion 20 around its circumference. The open top portion 14 includes a recessed upper lip portion 22. The upper lip portion 22 is characterized by having a rough textured surface 24, indicated by a plurality of horizontal lines.

The bag filling device 10 further includes a pair of semicircular handles 26 which in this figure are shown in a pivoted position adjacent the outer surface of the recessed upper lip portion 22 and engaging an open top 28 of a plastic bag 30. The plastic bag 30 can be seen disposed inside the tube 18 and extending therethrough with the open top 28 of the bag 18 extending through the open top portion 14 of the tube 12 with the edges of the top 28 of the bag 30 overlapping the recessed upper lip portion 22. The handles 26 compress the top 28 of the bag 30 against the rough textured surface 24 of the lip portion 22.

Also seen in this view is a pair of hand holes 31 for extending the fingers of the hand therethrough. The hand holes 31 are used for lifting the device 10 while filling the bag 30. Pivotally attached to one side of the tube 12 is a hook 32. The hook 32 is used for hanging the device 10 on the side of a wall when the device 10 is to be stored.

It should be noted that in FIG. 1, the bottom of the bag 30 extends downwardly through the open bottom portion 16 of the tube 12. As can be appreciated, various sizes of bags may be held by the device 10. Also, the size of the device 10 may vary for holding large bags used for lawn care down to smaller bags used for storing food products.

Figure 2:
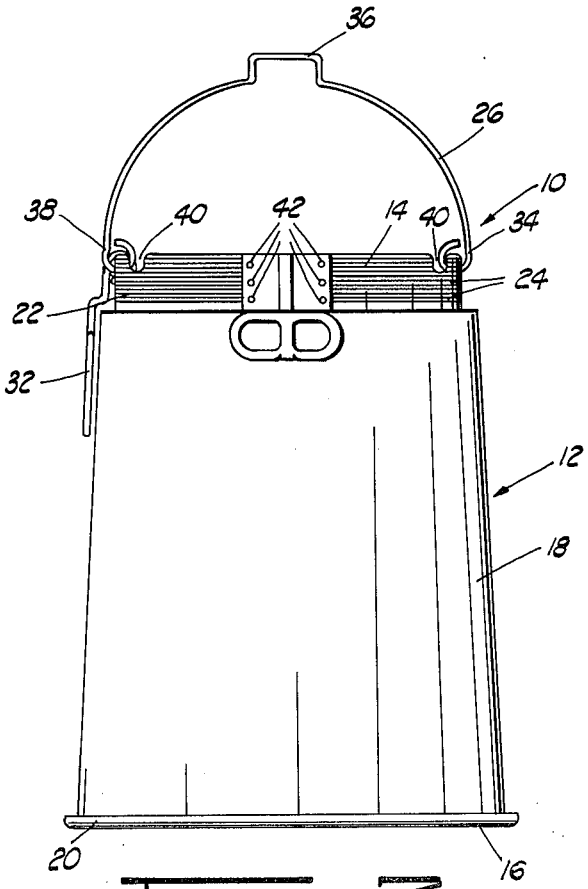
FIG. 2 is a front view of the bag filling device with the plastic bag removed and the handles in a raised position.

In FIG. 2, the handles 26 have been raised to a vertical position releasing the top 28 of the bag 30. Because of the tapered sides 18 of the tube 12, the device 10, when released from the bag 30, can be quickly slipped upwardly releasing the bag 30 therefrom. The bag 30 is then closed and tied.

In this view, the semicircular shape of the handles 26 can be seen. The handles 26 include a first end portion 34, a "U" shaped center portion 36, and a second end portion 38. The ends of the first and second end portions 34 and 38 of the handles 26 are inserted through apertures in the top of the lip portion 22 and curved therearound thereby securing the handles 26 to the tube 12. Adjacent the first and second end portions 34 and 36 of the handles 26 are notches 40 in the upper edge of the lip portion 22. The notches 40 provide means for allowing the open top 28 of the bag 30 to be wrapped around the annular surface of the recessed upper lip portion 24 without contacting the hook 32 and the end portions 34 and 38 of the handles 26.

The surface of the recessed upper lip portion 22 further includes outwardly extending protuberances 42. When the handles 26 are pivoted to a horizontal position and adjacent the surface of the lip portion 22, the "U" shaped center portion 36 of the handles 26 engage the protuberances 42. The protuberances 42 provide a snap fit against the center portion 36 of the handle 26 thereby securing the top 28 of the bag 30 therebetween and preventing the bag 30 from coming loose from the device 10 as the bag 30 is filled with various articles.

Figure 3:
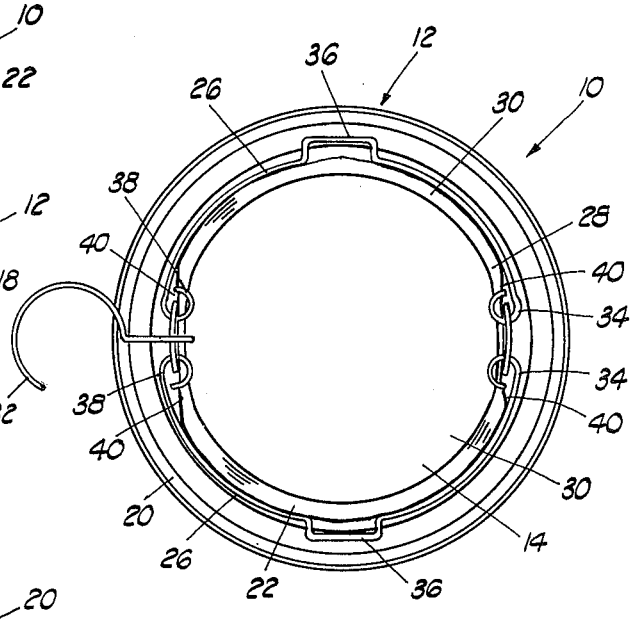
FIG. 3 is a top view of the bag filling device shown in FIG. 1.

In FIG. 3, a top view of the device 10 shown in FIG. 1 is illustrated. In this view, the top 28 of the bag 30 can be seen overlapping the top of the tube 12 and engaged between the outer surface of the lip portion 22 and the sides of the handles 26.

Also seen in this view is a portion of the top 28 of the bag 30 received in the notches 40 disposed on each side of the first end portions 34 and second end portions 38 of the handles 26.

Figure 4:
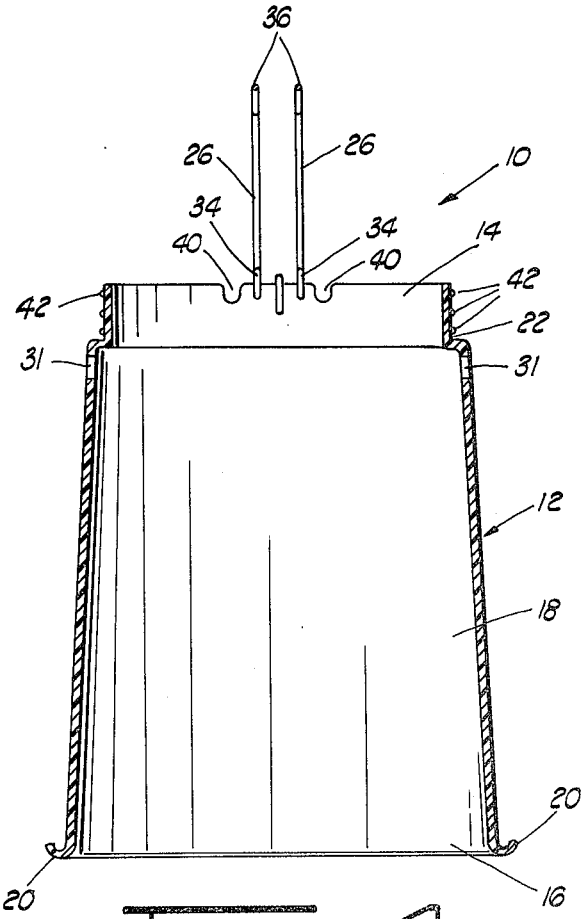
FIG. 4 is a front sectional view of the bag filling device.

In FIG. 4, a front sectional view of the device 10 is illustrated. In this view it can be seen that the hand holes 31 are disposed on opposite sides of the tube 12 so that the device 10 can be lifted with both hands when filling the bag 30. Seen in this view is the curved flange portion 20 of the open bottom portion 16 of the tube 12. Also shown is a cross section of the outwardly extending protuberances 42 disposed on opposite sides of the lip portion 22.

Changes may be made in the construction or arrangement of the parts or elements of the embodiments as disclosed herein without departing from the spirit or scope of the invention as defined in the following claims.

I claim:

1. A bag filling device for receiving a bag or the like therein, the device holding the bag in an open position for filling the bag with various articles, the device comprising:

a tube having an open top portion and an open bottom portion, the sides of said tube tapered upwardly and inwardly from the bottom portion to the top portion, said tube receiving the bag therein;

a recessed annular shaped upper lip portion disposed around the outside of the top portion of said tube, said lip portion having rough textured surface portions for engaging the edges of the open top of the bag when the top of the bag is overlapped against the surface of said lip portion;

a pair of sets of outwardly extending protuberances disposed on opposite sides of the surface of said lip portion and intermediate the rough textured surface portions;

a pair of semicircular handles having a first end portion, a second end portion, and a "U" shaped center portion, said handles parallel to each other when raised into a vertical position, the first end portion and the second end portion of said handles pivotally attached to the top of said lip portion, said handles when pivoted into a horizontal position adjacent the sides of said lip portion compressing the top of the bag against the textured surface of said lip portion, the "U" shaped center portion of said handles engaging said protuberances in a snap fit;

a hook pivotally mounted on said lip portion between the second end portions of said handles; and a plurality of notches disposed in the top of said lip portion and adjacent the first and second end portions of said handles, said notches receiving a portion of the top of the bag when the bag is overlapped on the surface of said lip portion, said notches allowing the bag to be wrapped around the surface of the upper lip portion without contacting said hook and the first and second end portions of said handles.

2. The device as described in claim 1, further including a plurality of hand holes in the sides of the top portion of said tube for inserting the fingers of the hand therethrough for lifting the device.

* * * * *